United States Patent [19]

Pressutti et al.

[11] Patent Number: 4,920,721

[45] Date of Patent: May 1, 1990

[54] HIGH PROFILE FIBERGLASS SHINGLE

[76] Inventors: Joseph E. Pressutti, 7323 N. Tamera; George E. Conley, 7616 N. Monte Ave., both of Fresno, Calif. 93711

[21] Appl. No.: 305,738

[22] Filed: Feb. 2, 1989

[51] Int. Cl.[5] ..... E04D 1/30

[52] U.S. Cl. ..... 52/518; 52/403; 52/542

[58] Field of Search ..... 52/309.1, 553, 536, 52/539, 541, 403, 54, 542, 518

[56] References Cited

U.S. PATENT DOCUMENTS

| | | | |
|---|---|---|---|
| 2,062,149 | 11/1936 | Stark et al. | 52/553 |
| 2,362,236 | 11/1944 | Bassler | 52/309.1 |
| 2,394,379 | 2/1946 | Herbes | 52/553 |
| 2,636,226 | 4/1953 | Holland | 52/553 |
| 2,648,103 | 8/1953 | Wahlfeld | 52/553 |
| 3,377,762 | 4/1968 | Chalmers et al. | 52/535 |
| 3,894,376 | 7/1975 | Shearer | 52/518 |
| 3,913,294 | 10/1975 | Freiborg | 52/555 |
| 4,015,391 | 4/1977 | Epstein et al. | 52/539 |

*Primary Examiner*—David A. Scherbel
*Assistant Examiner*—Caroline D. Dennison
*Attorney, Agent, or Firm*—Poms, Smith, Lande & Rose

[57] ABSTRACT

A shingle for simulating the textured appearance of a shake roof has a transverse axis and a longitudinal axis, as well as a weather surface and an inner surface. The shingle includes a fiber glass base with an upper edge and a butt edge extending in the transverse direction, as well as two side edges extending mainly in the longitudinal direction. At least one stiffening member is secured to the base and extends generally in the longitudinal direction. A sealing member, located adjacent to the butt edge of the base, extends mainly in the transverse direction and comprises an elongated strip of an elastic, deformable material.

20 Claims, 1 Drawing Sheet

FIG. 1
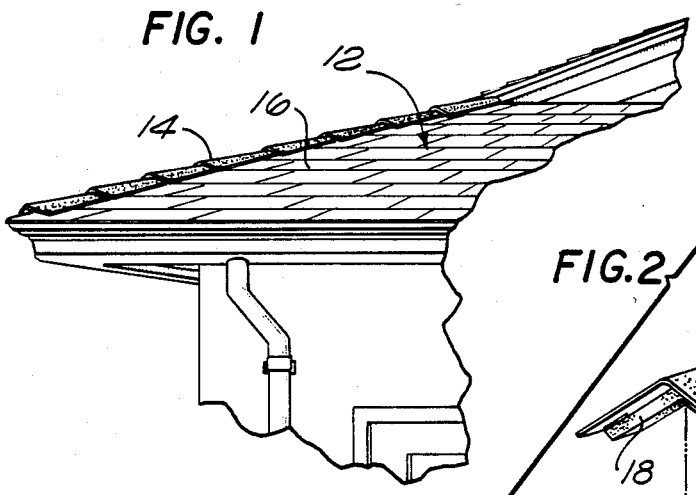
FIG. 2
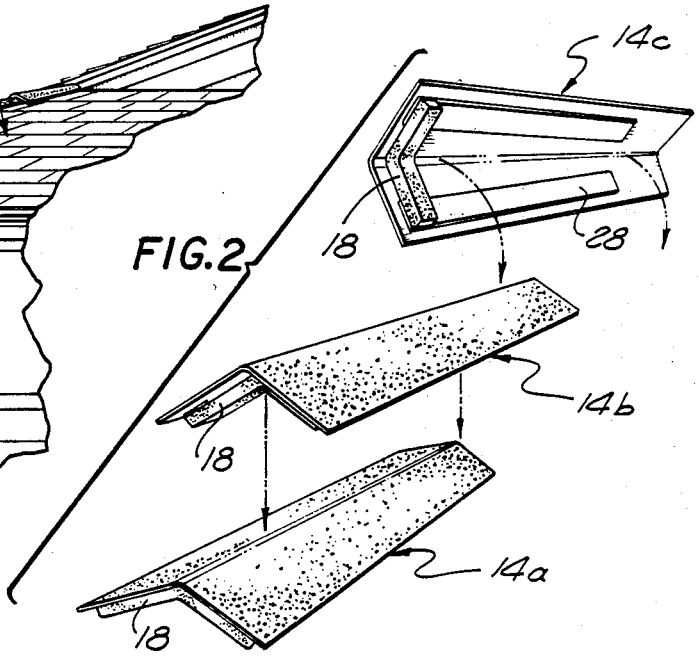
FIG. 3
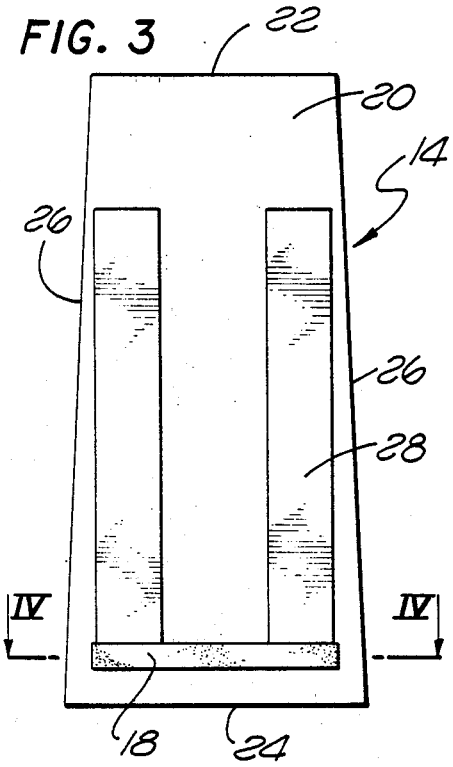
FIG. 4
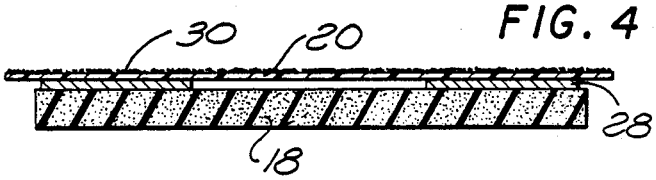
FIG. 5
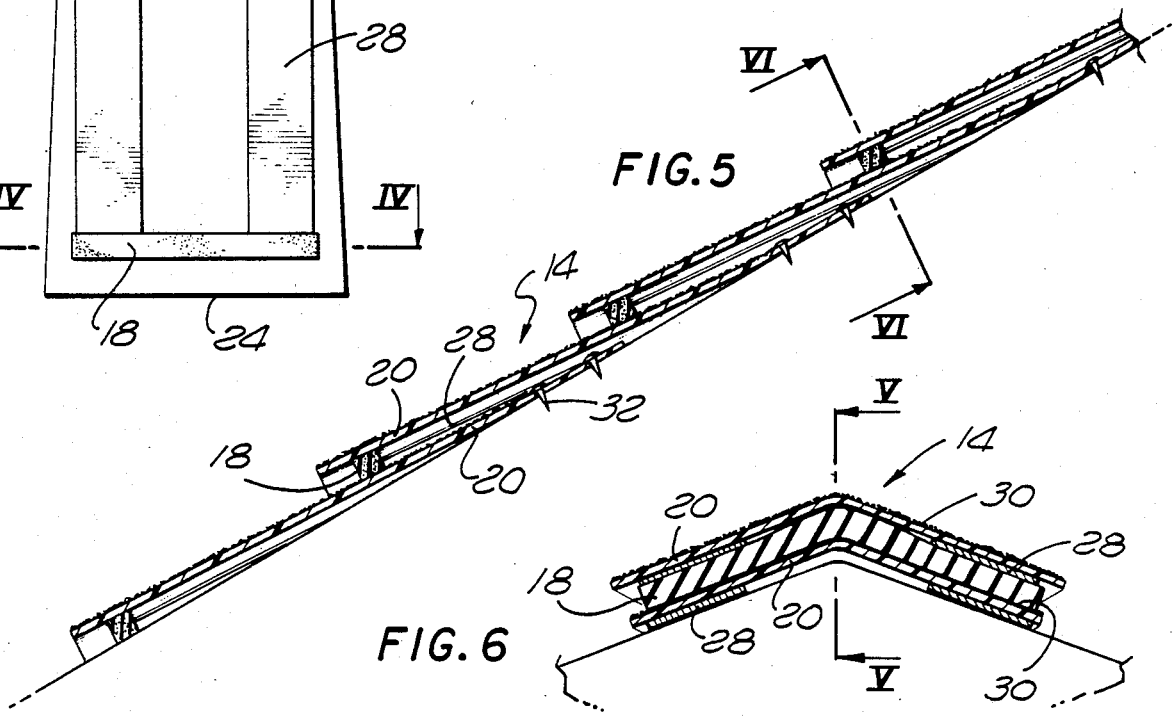
FIG. 6

HIGH PROFILE FIBERGLASS SHINGLE

FIELD OF THE INVENTION

The invention relates to the field of roofing, in particular to a fiber glass shingle which gives the appearance of a shake shingle.

BACKGROUND OF THE INVENTION

Almost every roofed structure is provided with some protective covering for the roof, and various types of roofing have been widely used for a long time. Examples of these are tiles, shingles, rocks, asphalt sheets, etc. Several factors must be considered when choosing a particular type of roofing. Obviously, perhaps the most important function of roofing is to protect the underlying structure from the effects of the weather. When the roof is covered by a pattern of overlapping elements such as shingles, not only must each individual element be impervious to the weather, the areas where adjacent shingles overlap and adjoin each other must also provide an effective weather seal.

Other factors are cost, weight, and ease of manufacture and installation. Tiles, for example, usually provide relatively long-life protection, but they are correspondingly expensive and heavy. The greater weight of tiles means, moreover, that not only are they more difficult to install, but in some cases it may even be necessary to strengthen the underlying supporting structure of the roof.

Yet another factor when choosing roofing material is the appearance of the covering. Although it is usually easy to vary the color of the outer surface of the covering, for example by fixing colored granules on it at the time of manufacture, other features are not as easily provided. In particular, the flat and bland appearance of roofs covered with sheeting or common asphalt shingles is often considered less pleasing than the textured appearance of tiled or wood shake roofs.

One type of roof which gives the impression of texture and depth associated with tiled roofs is the shake roof. This roof is made up of a pattern of overlapping, tapered wooden strips which are nailed to the roof like shingles. Although a shake roof is somewhat more expensive and much lighter than a tiled roof, there are several disadvantages associated with the use of wood. Long-term exposure to the environment typically leads to buckling and cracking of the wooden strips, which in turn leads to a corresponding worsening of the protective seal provided by the shake roof. Also, unless specially treated, wooden roofs constitute a much greater fire hazard than roofs covered with other materials.

One attempt at giving a textured profile to a roof covering while using relatively inexpensive asphalt shingles is described in U.S. Pat. No. 3,913,294 (Freiborg). Each shingle in this roofing system exhibits a thickened portion formed by folding the shingle several times so that the folds extend laterally across a central region. The shingles are installed in such a way that the lower edge of each overlying shingle extends over and beyond the thickened portion of its underlying shingle. In this way, the lower edge of each shingle is raised relative to its upper portion, thereby adding depth.

The disadvantage of this shingle is that it is not possible to apply such a technique using multiple, sharp folds or bends to shingles made of stiffer or more brittle materials. In particular, it cannot be used for shingles made of fiber glass, which are more durable than roof coverings made of organic materials such as asphalt and wood, but which tend to crack when bent sharply.

U.S. Pat. No. 2,062,149 (Stark et al.) describes a shingle consisting of an elongated sheet or strip of composite roofing material. In order to create a textured profile, a lath is secured near and parallel to the lower edge of each strip. The lower edge itself is then bent down substantially at a right angle over the lath to form a lip. Bending a portion of the covering strip or shingle sharply over a thickened lower portion of an underlying element in order to form a lip and provide depth is also utilized in U.S. Pat. No. 3,377,762 (Chalmers et al.). In this system, the material which must be bent to form the lip is metal, in particular, aluminum. In both of these systems, part of the covering element must be bent sharply, so that both preclude the advantageous use of materials such as fiber glass.

U.S. Pat. No. 2,394,379 (Herbes) describes an outer wall covering intended to simulate the appearance of clapboard siding. According to this system, elongated wooden battens are first nailed in equally spaced parallel rows to underlying sheathing over the entire height of the wall to be covered. Elongated flat siding boards of asbestos-cement are then nailed in position, whereby the upper edge of each butts against the lower face of the battens of the next upper row and the lower edge bears on and overhangs the battens of the next lower row. First, this covering involves a siding, not a roof cover. Second, it uses asbestos-containing siding boards, so that a dangerous material must be handled upon manufacture. Third, this solution relies on wooden battens, which, as is pointed out above, are prone to relatively rapid deterioration. Finally, the battens in this wall covering are elements separate from the siding boards, and must be handled and installed separately.

A siding structure similar to that found in Herbes, and exhibiting similar limitations and disadvantages, is disclosed in U.S. Pat. No. 2,648,103 (Wahlfield). According to this system, an elongated molding wooden member having a relatively complicated cross section is fastened along the lower edge of each of a number of wooden siding boards. When installed, the upper edge of each siding board mates with a corresponding offset which must be formed in the inner lower edge of the molding member of the siding board in the next higher row. In an alternative embodiment, a metal profile replaces the wooden molding member, whereby the offset is created by bending the profile a number of times at substantially right angles. A wedge-shaped member is additionally required to support the siding boards and to improve their ability to seal out the environment.

Accordingly, the object of the present invention is to provide a roof covering which not only gives the pleasing appearance of a shake roof, but also seals well against the environment, resists bending, and combines durability and affordability with ease of manufacture and installation.

SUMMARY OF THE INVENTION

In accordance with a specific embodiment of the present invention, a shingle is provided having a transverse axis and a longitudinal axis, as well as a weather surface and an inner surface, and including: a base comprising a sheet of fiber glass having an upper edge and a butt edge extending in the transverse direction, as well as two side edges extending mainly in the longitudinal direction; at least one stiffening member secured to the base and extending generally in the longitudinal direction; and a sealing member extending mainly in the transverse direction comprising an elongated strip of an elastic, deformable material and located adjacent to the butt edge of the base. Furthermore, the sealing member is provided for increasing the apparent thickness of the butt edge of the base and for seating against the weather surface of an underlying shingle.

In accordance with another aspect of the invention, when the shingle, which is manufactured using a stiff, non-foldable material, is to be used to cover an angled roof ridge or hip, its base is provided to be bendable to conform to the angle of the roof ridge or hip, with its upper edge and butt edge extending mainly perpendicular to the ridge or hip, and its two side edges extending mainly parallel to the ridge or hip. The sealing member is similarly provided for increasing the apparent thickness of the butt edge of the base of each shingle and for seating against the weather surface of the underlying shingle The advantages of the shingles according to the present invention are that they provide an easily installed and manufactured roof covering using a durable, long-lasting and relatively inexpensive material such as fiber glass, while providing an effective weather seal and simulating the textured appearance of, a shake roof.

BRIEF DESCRIPTION OF THE DRAWINGS

FIG. 1 illustrates a section of a roof, and a roof ridge covered with the present shingle;

FIG. 2 shows the manner in which the present shingles are installed;

FIG. 3 is a view from below of an exemplifying embodiment of the present shingle;

FIG. 4 is a sectional view of the present shingle taken on the line IV—IV of FIG. 3;

FIG. 5 is a vertical sectional view taken through a series of installed shingles, generally along the line V—V in FIG. 6; and FIG. 6 is a vertical sectional view taken approximately on the line VI—VI of FIG. 5.

DETAILED DESCRIPTION

Referring more particularly to the drawings, FIG. I shows a roof, designated generally by the reference numeral 12. A series of mainly identical shingles 14 are shown mounted on and covering a ridge or hip of the roof, the ridge or hip being defined by the intersection of two generally planar roof surfaces. In FIG. 1, for the sake of simplicity, only one of the shingles is identified. FIG. 1 also illustrates the textured appearance, similar to that of a shake roof, created by the present shingles when installed as described below. This is to be contrasted with the bland and untextured appearance of the mainly planar roof surface 16 which, in FIG. 1, is illustrated as being covered in a conventional manner with common flat shingles.

FIG. 2 illustrates the manner in which three of the present shingles **14*a*, 14*b*, and 14*c* are mounted one on the other in order to cover the roof ridge or hip. Shingle 14*a* is first bent longitudinally approximately along its centerline in order to conform to the angle of the ridge or hip, and is then secured in place as will be described below. It is to be noted that the angle at which it must be bent usually will be obtuse. When the shingle 14*a* is secured, an elastic sealing member 18** seats against the outer surface of the ridge or hip, or of an underlying, previously installed shingle.

The succeeding shingle **14*b* is thereafter similarly bent and is laid upon the preceding shingle 14*a* so that they are approximately aligned, the shingle 14*b* being longitudinally displaced relative to the shingle 14*a*. The following shingle 14*c* is thereafter installed overlapping the shingle 14*b* in the same manner shingle 14*b* is installed on shingle 14*a*. This procedure of mounting a shingle on an underlying shingle is continued until the roof ridge or hip, or any chosen portion thereof, is covered. This installation method is of course analogous to the way in which conventional shingles normally are installed on a roof ridge or hip. FIG. 2** therefore illustrates that no special mounting steps such as folding are required when using the shingle according to the present invention.

FIG. 3 shows a view of the underside of one exemplifying embodiment of the present shingle 14. As this figure shows, each shingle 14 includes a generally planar base 20. The base 20 exhibits an upper edge 22 and a lower edge 24, which extend in a transverse direction, as well as two side edges 26, which extend generally in a longitudinal direction. FIG. 3 shows the base being generally trapezoidal, but this shape is not essential to the invention. For example, the base may be rectangular, have curved edges, rounded corners, be unsymmetrical, etc., the choice of shape being restricted only by the requirement that the shingles, when installed, should effectively cover and protect the underlying roof and not leave areas unexposed.

The base is made primarily of an inorganic roofing material, preferably fiber glass, which is relatively inexpensive and easy to cut to shape. One shingle which may be used to advantage is that provided with a filled coating, by which is meant that an ordinary fiber glass shingle is impregnated with asphalt-based materials and includes a filler often containing granite particles to increase the durability of the shingle. Another suitable shingle embodies styrene butyl-styrene (S.B.S.) and modified asphalt.

In order to increase the ability of the shingle to withstand bending and possible detachment by the wind, at least one stiffening member 28 is secured by means of, for example, glue or staples, to the base 20. In the present exemplifying embodiment, two stiffening members in the form of battens 28 are included and are mounted in the longitudinal direction, that is, mainly perpendicular to the butt edge 24. The length of the battens is chosen preferably so that the upper and lower ends of each batten are at a distance from the upper and butt edges, respectively, of the base 20. The advantage of this spacing will be explained below. The stiffening member(s) may be made easily and inexpensively from pressboard, plastic, etc.

More than two stiffening members may also be mounted on the base. For certain structures it may for example be found preferable to include several thin members. Alternatively, a single wide batten may be preferred. In either case, if the shingle is to be used on the angled ridge or hip of a roof, any stiffening member which covers the longitudinal centerline of the base should be able to conform to the angle of the ridge or hip. If plastic is used for this stiffening member, it may be originally manufactured with the required bend.

As is shown in FIG. 3, the elongated elastic sealing member 18 is preferably secured to the stiffening members 28, e.g. by gluing or stapling, mainly parallel to the lower edge 24. Alternatively, the sealing member may be secured directly on the base 20. By positioning the sealing member 18 at a distance from the lower edge 24 of the base as shown in FIG. 3, when the shingles are installed as shown in FIG. neither the member itself nor the lower ends of the stiffening members will be conspicuous; rather, a distinct shadow line will be cast on the underlying shingle, thereby increasing the attractiveness of the covering. Similarly, there is also preferably a space between each end of the sealing member and the corresponding side edge 26 of the base, so that when the shingle is installed, the member will not extend beyond the side edges of either the shingle to which it belongs or the underlying shingle. The sealing member is manufactured as a strip of weather-resistant, deformable, elastic material such as rubber, rubber or butyl composition, closed or open cell foam, etc. so that, when pressed against the weather surface of an underlying shingle, it molds itself to the surface to provide an effective weather seal.

The vertical cross-sectional view of the present shingle shown in FIG. 4 illustrates more clearly the mounting of the stiffening members 28 and the sealing member 18 on the base 20, as well as their approximate relative thicknesses. FIG. 4 illustrates further that the shingle exhibits a weather surface 30 which in a conventional manner may provided with a covering of colored granules to further protect the surface and to increase the attractiveness of the roof.

The overlapping pattern of installed shingles is illustrated in FIG. 5. The shingles are installed generally in the conventional manner. Fastening elements 32 such as nails, tacks or staples are driven through the base 20 in a securing region defined as the region between the upper ends of the stiffening members 28 and the upper edge 22 of the base, into the underlying roof covering. In the example shown, two tacks 32 are used above each of the two stiffening members. The number of tacks may, however, of course be varied depending on how strongly the shingles must be attached to the roof.

If at least the upper portion of the stiffening members is sufficiently flexible, and the upper ends of the members terminate at or close to the upper edge of the base, the fastening elements should be driven through the stiffening members as well.

As shown in FIG. 5, the sealing member 18 is approximately square in cross section. Although this shape provides ease of fastening and stability with a minimum of material, the cross-sectional form of the sealing member is not essential to the invention and may also be rectangular, or have some other shape.

FIG. 6 shows a cross section, taken generally on the line VI—VI in FIG. 5, of a roof hip covered with the present shingles. As is shown in the figure, when installed, the sealing member 18 of an overlying shingle seats against the weather edge 30 of an underlying shingle. Because of the deformability of the sealing member, it will seal effectively even if the underlying weather surface is granulated and rough. The figure also illustrates more clearly how limiting the length of the sealing member as described above prevents it from extending beyond the side edges of the underlying shingle and becoming conspicuous.

In one specific embodiment of the present shingle, configured as shown in the figures, the upper edge of the base was from six to seven inches long, the butt edge was from seven to nine inches long, and each side edge was from 15 to 17 inches long. Each of the two battens was made of pressboard was from 1.5 to 2.5 inches Wide; was from 11 to 13 inches long; was stapled to the base so that it extended from 0.5 to 1.5 inches from the butt edge of the base to three to five inches from the upper edge; and was parallel to the respective side edge of the base with a spacing of approximately 0.5". The sealing member was made of rubber, or a rubber or butyl composition, with a square cross section approximately 0.5" to the side. It was cut to length so that each end terminated at the outer edge or the respective batten. Whereas the base was less than 0.1" thick, the combined thickness of the base, battens and sealing member was greater than 0.6". The shingle thus provided an apparent increase in thickness of over 600%.

Although the shingle according to the invention has been described for use in covering a roof hip, it may of course also be used to cover flat roof surfaces.

What is claimed is:

1. A roofing accessory shingle for use only along angled roof locations such as ridges, hips, and rakes, said shingle having a transverse axis and a longitudinal axis, as well as a weather surface and an inner surface, including:

a base comprising a continuous, flexible sheet of fiber glass having an upper edge and a butt edge extending in the transverse direction, as well as two side edges extending mainly in the longitudinal direction;

at least one stiffening member secured to the base and extending generally in the longitudinal direction;

a sealing member extending mainly in the transverse direction comprising an elongated strip of an elastic, deformable material and located adjacent to the butt edge of the base; and said shingle including the fiber glass sheet and elastic sealing member being flexible to permit bending of said shingle about its longitudinal axis for mounting at angled roof locations such as ridges, hips, and rakes.

2. A shingle as defined in claim 1, wherein the sealing member is provided for increasing the apparent thickness of the butt edge of the base and for seating against the weather surface of an underlying shingle.

3. A shingle as defined in claim 2, wherein the sealing member is manufactured of rubber.

4. A shingle as defined in claim 1, wherein the base exhibits a securing region between the upper edge and the upper end of the said at least one stiffening member.

5. A shingle as defined in claim 45, wherein the stiffening members are two in number and are positioned on either side of a centerline of the base.

6. A shingle as defined in claim 4 provided with a single stiffening member extending on either side of a centerline of the base.

7. A shingle as defined in claim 2, wherein the sealing member is fastened to said at least one stiffening member.

8. A shingle for covering a roof ridge/hip, having a longitudinal axis, as well as a weather surface and an inner surface, including:

a base comprising a sheet of a stiff, non-foldable material, bendable to conform to the angle of the roof ridge/hip when mounted thereon, having an upper edge and a butt edge extending mainly perpendicular to the ridge/hip, as well as two side edges extending mainly in the longitudinal direction;

at least one stiffening member secured to the base and extending generally in the longitudinal direction; and a sealing member located adjacent to and extending mainly parallel to the butt edge, comprising an elongated strip of an elastic, deformable material.

9. A shingle as defined in claim 8, wherein the sealing member is provided for increasing the apparent thickness of the butt edge of the base and for seating against the weather surface of an underlying shingle.

10. A shingle as defined in claim 9, wherein the sealing member is manufactured of rubber.

11. A shingle as defined in claim 8, wherein the base exhibits a securing region between the upper edge and the upper end of the said at least one stiffening member.

12. A shingle as defined in claim 11, wherein the stiffening members are two in number and are positioned on either side of the centerline of the base.

13. A shingle as defined in claim 11 provided with a single stiffening member which extends on either side of a centerline of the base and is prevent to conform to the angle of the ridge/hip.

14. A shingle as defined in claim 9, wherein the sealing member is fastened to said at least one stiffening member.

15. A shingle as defined in claim 8, wherein the stiff, non-foldable material is fiber glass.

16. A shingle as defined in claim 15, including a filled coating.

17. A shingle as defined in claim 15, including a modified coating of styrene butyl-styrene.

18. A shingle as defined in claim 8, wherein the upper edge of the base is from six to seven inches long, the butt edge is from seven to nine inches long, each side edge is from 15 to 17 inches long; the number of stiffening members is two, whereby each is from 1.5 to 2.5 inches wide, from 11 to 13 inches long, extends from 0.5 to 1.5 inches from the butt edge of the base to three to five inches from the upper edge, and is mounted parallel to the respective side edge of the base with a spacing of approximately 0.5"; the sealing member has a square cross section approximately 0.5" to the side and terminates at either end at the edge of the respective batten nearest the respective side edge of the base; and the base is less than 0.1" thick, and the combined thickness of the base, battens and sealing member is greater than 0.6".

19. A roof ridge/hip provided with an overlapping pattern of shingles, each having a weather surface and an inner surface and including:

first and second non-parallel, substantially planar roof surfaces having a line or region of intersection;

a shingle base, comprising a sheet of fiber glass, bendable to conform to the angle of the roof ridge/hip and having an upper edge and a butt edge extending over each of said first and second roof surfaces mainly perpendicular to the line or region of intersection, as well as two side edges extending mainly parallel to the roof line or region of intersection;

at least one stiffening member secured to the base and extending generally parallel to the roof line or region of intersection;

a sealing member located adjacent to and extending mainly perpendicular to the roof line or region of intersection and extending over each of said first and second roof surfaces, comprising an elongated strip of an elastic, deformable material;

wherein the sealing member of each overlying shingle seats against the weather surface of a corresponding underlying shingle for increasing the apparent thickness of the butt edge of the base and providing a weather seal.

20. A roof ridge/hip as defined in claim 19, in which the sealing member of each shingle is located at a distance to the butt edge of its respective base.

* * * * *